US009042766B2

(12) United States Patent
Ueda et al.

(10) Patent No.: US 9,042,766 B2
(45) Date of Patent: May 26, 2015

(54) COOLING DEVICE AND IMAGE FORMING APPARATUS INCLUDING SAME

(71) Applicants: Yuta Ueda, Tokyo (JP); Toshihiro Shimada, Kanagawa (JP)

(72) Inventors: Yuta Ueda, Tokyo (JP); Toshihiro Shimada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 93 days.

(21) Appl. No.: 13/778,260

(22) Filed: Feb. 27, 2013

(65) Prior Publication Data

US 2013/0251392 A1 Sep. 26, 2013

(30) Foreign Application Priority Data

Mar. 21, 2012 (JP) ..... 2012-063399

(51) Int. Cl.

*G03G 21/16* (2006.01)
*G03G 15/20* (2006.01)
*G03G 15/00* (2006.01)

(52) U.S. Cl.

CPC .... *G03G 15/2021* (2013.01); *G03G 2221/1645* (2013.01); *G03G 21/1695* (2013.01); *G03G 15/6573* (2013.01)

(58) Field of Classification Search

USPC ..... 399/92
See application file for complete search history.

(56) References Cited

U.S. PATENT DOCUMENTS

| | | | | |
|---|---|---|---|---|
| 5,426,495 | A * | 6/1995 | Sawamura et al. | 399/331 |
| 5,826,141 | A * | 10/1998 | Mitsuya | 399/122 |
| 6,226,178 | B1 * | 5/2001 | Broder et al. | 361/679.52 |
| 7,603,050 | B2 * | 10/2009 | Kim | 399/92 |
| 7,634,211 | B2 * | 12/2009 | Driessen-Olde Scheper et al. | 399/94 |
| 7,937,014 | B2 * | 5/2011 | Kawamata | 399/92 |
| 8,655,253 | B2 * | 2/2014 | Kunii et al. | 399/341 |
| 2007/0003314 | A1 | 1/2007 | Shuto | |
| 2007/0256813 | A1 * | 11/2007 | Ho | 165/80.3 |
| 2011/0052247 | A1 * | 3/2011 | Saitoh et al. | 399/94 |

FOREIGN PATENT DOCUMENTS

| | | | |
|---|---|---|---|
| JP | 55117179 | A * | 9/1980 |
| JP | 08145045 | A * | 6/1996 |
| JP | 10-247052 | | 9/1998 |
| JP | 11-015308 | | 1/1999 |
| JP | 11015308 | A * | 1/1999 |
| JP | 2007-041541 | | 2/2007 |
| JP | 2009-020155 | | 1/2009 |

* cited by examiner

*Primary Examiner* — Clayton E LaBalle
*Assistant Examiner* — Leon W Rhodes, Jr.
(74) *Attorney, Agent, or Firm* — Harness, Dickey & Pierce

(57) ABSTRACT

A cooling device including a heat pipe to cool a sheet, a radiator provided to an end of the heat pipe, and a duct accommodating the radiator and having a closably openable cover member. The cover member is openable to enable attachment and detachment of the heat pipe to and from the cooling device in a predetermined direction.

9 Claims, 8 Drawing Sheets

COOLING DEVICE AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2012-063399, filed on Mar. 21, 2012, in the Japan Patent Office, the entire disclosure of which is hereby incorporated by reference herein.

BACKGROUND

1. Technical Field

Exemplary aspects of the present invention generally relate to a cooling device that cools a recording medium such as a sheet of paper, and an image forming apparatus including the cooling device.

2. Related Art

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

An example of a widely used fixing device is a heat fixing device including a fixing member such as a fixing roller or a fixing belt heated by a heat source and a pressing member such as a pressing roller that presses against the fixing member. A sheet of paper or the like having an unfixed toner image thereon is conveyed between the fixing member and the pressing member so as to fix the toner image onto the sheet at the nip using heat and pressure.

To cool the sheet thus heated by the heat fixing device after fixing of the toner image onto the sheet, a heat pipe that transfers the heat from the sheet to the exterior of the device is often used as a cooling member.

In general, a radiator provided with radiating fins or the like is provided to an end of the heat pipe, and an air blower such as a fan blows air onto the radiator to dissipate the heat. The radiator and the air blower are generally covered with a duct member to enhance cooling efficiency.

However, the configuration of the related-art cooling device, in which a shaft of the heat pipe is inserted into holes formed in the duct member, hinders attachment and detachment of the heat pipe to and from the cooling device.

Further, a gap is generated between the heat pipe and the holes, possibly resulting in leakage of cool air outside from the cooling device.

SUMMARY

In view of the foregoing, illustrative embodiments of the present invention provide a novel cooling device that facilitates attachment and detachment of a heat pipe to and from the cooling device and prevents leakage of cool air outside from the cooling device, and an image forming apparatus including the cooling device.

In one illustrative embodiment, a cooling device includes a heat pipe to cool a sheet, a radiator provided to an end of the heat pipe, and a duct accommodating the radiator and having a closably openable cover member. The cover member is openable to enable attachment and detachment of the heat pipe to and from the cooling device in a predetermined direction.

In another illustrative embodiment, an image forming apparatus includes a fixing device to fix a toner image onto a sheet with heat and the cooling device described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
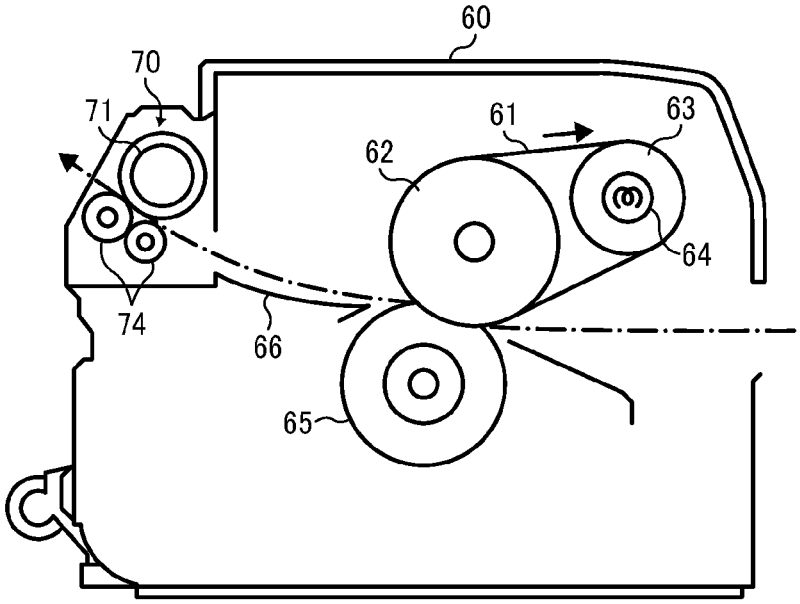
FIG. 1 is a vertical cross-sectional view illustrating an example of a configuration of a fixing device according to an illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A configuration and operation of a fixing device 60 according to an illustrative embodiment is described in detail below.

Figure 2:
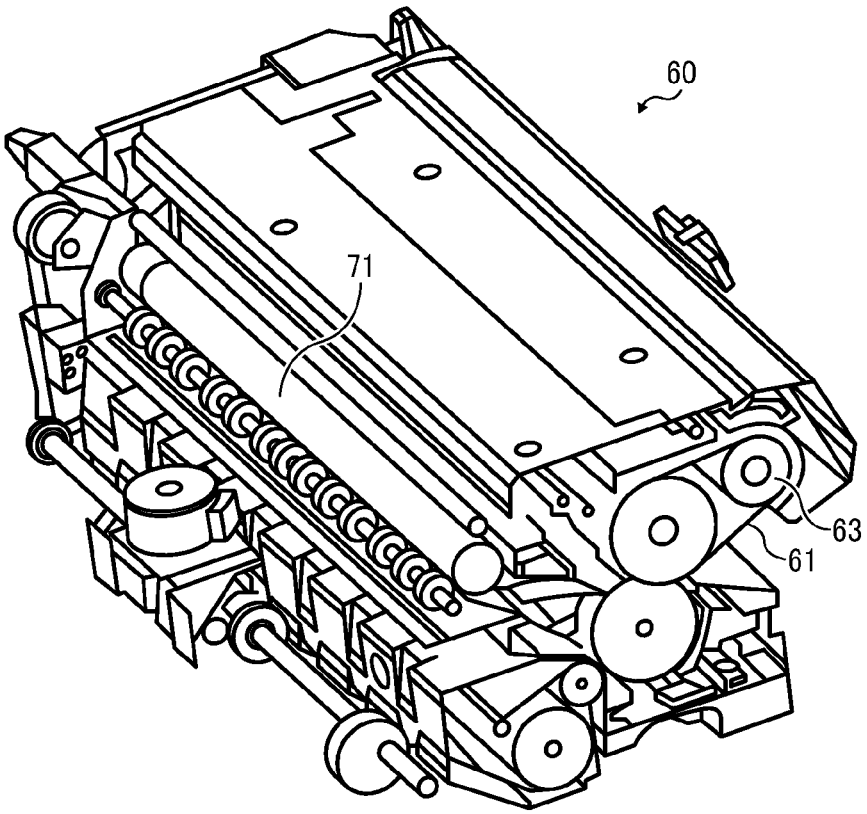
FIG. 2 is a perspective view of the fixing device illustrated in FIG. 1.

FIG. 1 is a vertical cross-sectional view illustrating an example of a configuration of the fixing device 60 according to the illustrative embodiment viewed from the front. FIG. 2 is a perspective view of the fixing device 60 illustrated in FIG. 1. It is to be noted that although the fixing device 60 according to the present illustrative embodiment employs a belt fixing system using a fixing belt, the configuration of the fixing device 60 is not limited thereto. Alternatively, for example, the fixing device 60 may employ a roller fixing system using a fixing roller.

The fixing device 60 includes a fixing member, which, in the present illustrative embodiment, is a fixing belt 61. The fixing belt 61 is wound around a drive roller and a driven roller, which, in the present illustrative embodiment, are a fixing roller 62 and a heat roller 63, and is rotated in a clockwise direction in FIG. 1. The fixing roller 62 is constructed of an elastic layer provided around a metal core and is rotatively driven by a drive mechanism, not shown. A fixing heater 64 is provided as a heat source within the heat roller 63 to heat the heat roller 63, and thus the heat roller 63 heats the fixing belt 61.

A pressing roller 65 having an elastic layer is provided opposite the fixing roller 62 with the fixing belt 61 interposed therebetween, and is pressed against the fixing roller 62 via the fixing belt 61 by a pressing mechanism, not shown. The fixing belt 61 is rotated as the fixing roller 62 rotates, and the pressing roller 65 is rotated as the fixing belt 61 rotates. It is to be noted that, alternatively, the pressing roller 65 may also be rotatively driven by a drive mechanism. Further alternatively, a heater that heats the pressing roller 65 may also be provided. In addition, a pressing belt or the like may be used in place of the pressing roller 65.

A temperature detector, not shown, is provided outside the heat roller 63 in contact with or near the heat roller 63 to detect a temperature on a surface of the fixing belt 61. A temperature controller, not shown, controls the fixing heater 64 based on a value output from the temperature detector such that the surface of the fixing belt 61 has a predetermined temperature. Examples of the temperature detector include, but are not limited to, a thermistor and a thermopile.

A sheet bearing an unfixed toner image thereon is conveyed from right to left in FIG. 1 as indicated by a broken arrow to a nip formed between the fixing belt 61 and the pressing roller 65. At the nip, toner of the toner image is melted and fixed onto the sheet by the fixing belt 61, which is controlled to have the predetermined temperature, and the pressing roller 65.

A separation member, not shown, such as a separation pick or a separation plate is disposed near an exit of the nip so that the sheet is separated from the fixing belt 61 after fixing of the toner image onto the sheet. Thereafter, the sheet is conveyed along a guide plate 66. A cooling device 70 is disposed at a discharge part of the fixing device 60 to cool the sheet after the fixing of the toner image onto the sheet. The cooling device 70 is integrated with the fixing device 60 and conveys the sheet downstream in a direction of conveyance of the sheet while cooling the sheet using a heat pipe 71.

During the fixing of the toner image onto the sheet, moisture within the sheet is vaporized when the sheet is heated and transforms into steam. The steam may cause condensation within the fixing device 60, resulting in sheet jam and deterioration in image quality.

To solve the above problems, the cooling device 70 is provided at the discharge part of the fixing device 60. The cooling device 70 efficiently cools the sheet using the heat pipe 71 while conveying the sheet after the fixing of the toner image onto the sheet and prevents occurrence of condensation within the fixing device 60. As illustrated in FIG. 2, a cooling part of the heat pipe 71 that cools the sheet, that is, a shaft 71*a* of the heat pipe 71 (shown in FIG. 8), is exposed outside a casing of the fixing device 60.

It is to be noted that, in general, radiating fins are provided to an end of the heat pipe, and an air blower such as a fan blows air onto the radiating fins. In addition, for the purpose of increasing cooling efficiency, a duct having an air inlet and an air outlet is disposed to accommodate, sometimes with the air blower, a radiating part including the radiating fins provided at the end of the heat pipe.

For comparison with the cooling device 70 according to the present illustrative embodiment, a description is now given of a configuration and installation of a related-art cooling device with reference to FIGS. 3 to 6.

Figure 3:
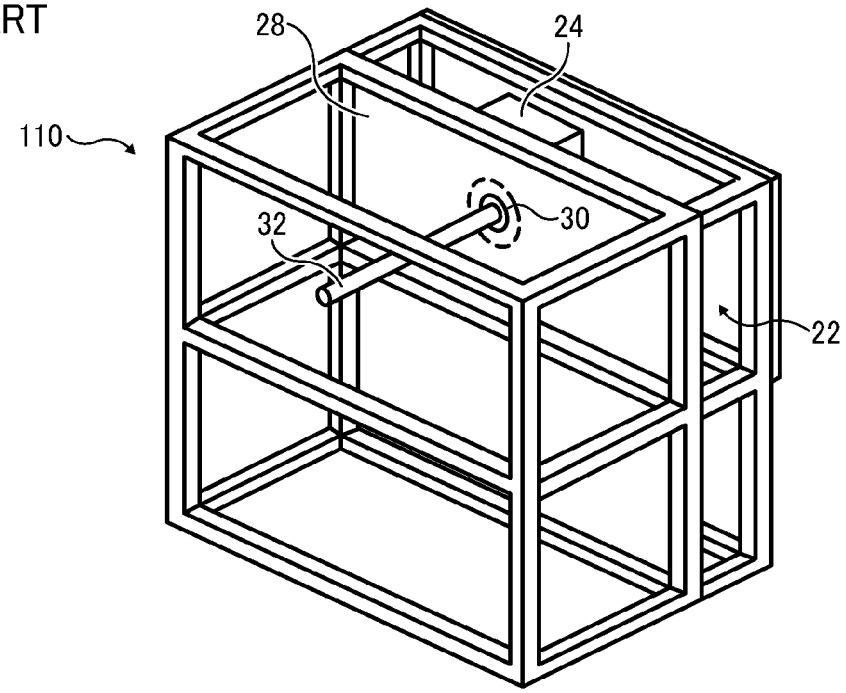
FIG. 3 RELATED ART
FIG. 3 is a perspective view illustrating an example of attachment of a cooling device to an image forming apparatus according to the related art.

FIG. 3 is a perspective view illustrating an example of attachment of a duct chamber 22 to a housing 110 of an image forming apparatus according to the related art. The duct chamber 22 is disposed at the rear of the housing 110, and a duct 24 is provided within the duct chamber 22. A rear plate 28 of the housing 110 has an installation hole 30 formed therein, and a heat pipe 32 is inserted into the installation hole 30.

In such a configuration, the duct 24 encompassed by the housing 110 and lateral plates of the duct chamber 22 must be detached before withdrawal of the heat pipe 32 from the image forming apparatus, thereby hindering installation and detachment of the heat pipe 32. In addition, a gap is generated between the heat pipe 32 and a hole formed in the duct 24 (and the installation hole 30), possibly resulting in leakage of cool air.

Figure 4:
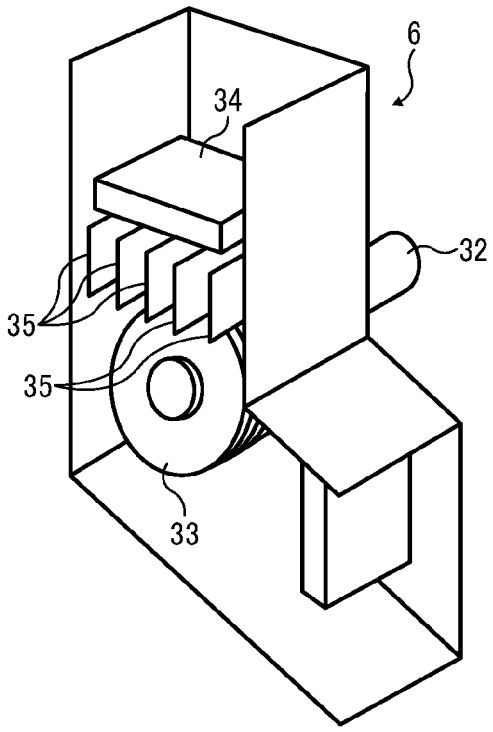
FIG. 4 RELATED ART
FIG. 4 is a perspective view illustrating another example of a configuration of a cooling device according to the related art.

FIG. 4 is a perspective view illustrating another example of a configuration of a cooling device according to the related art. Radiating fins 33 are provided at the end of the heat pipe 32, and a suction fan 34 is provided above the radiating fins 33 with guide plates 35 interposed therebetween. All the above-described components are disposed within a duct 6. Similar to the configuration illustrated in FIG. 3, the cooling device including the heat pipe 32 and so on illustrated in FIG. 4 is disposed within the duct chamber 22 encompassed by the housing 110 and lateral plates.

Consequently, the duct 6 must be detached from the image forming apparatus before withdrawal of the heat pipe 32, thereby hindering installation and detachment of the heat pipe 32. In addition, a gap is generated between the heat pipe 32 and an insertion hole formed in the duct 6, possibly resulting in leakage of cool air.

Figure 5:
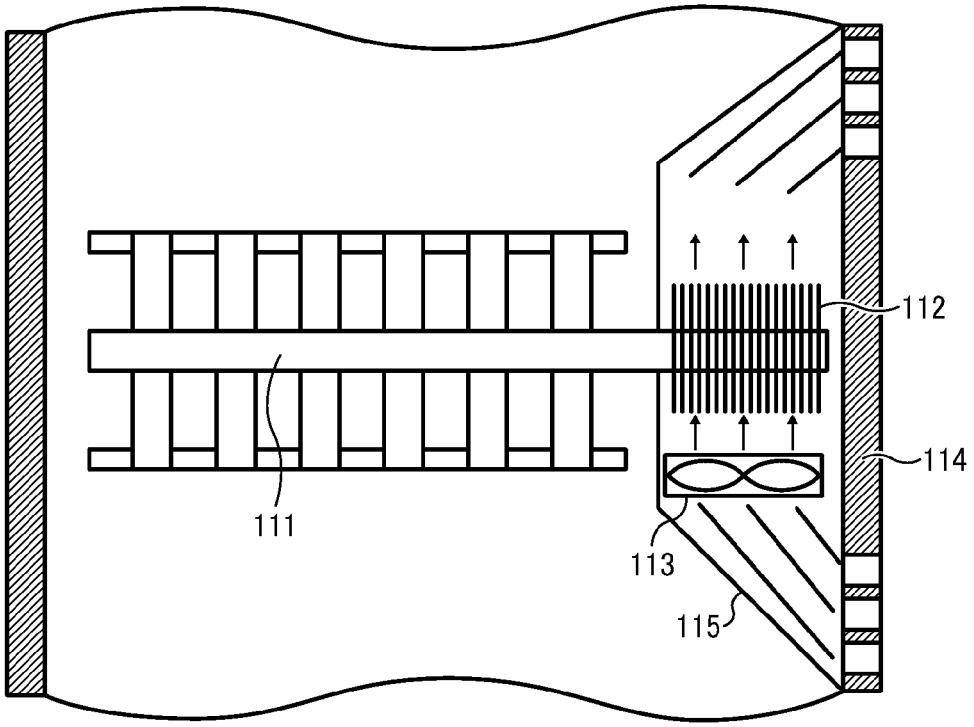
FIG. 5 RELATED ART
FIG. 5 is a schematic view illustrating another related-art example of a configuration of a cooling device attached to an image forming apparatus.

FIG. 5 is a schematic view illustrating another related-art example of a configuration of a cooling device attached to an image forming apparatus. A partition wall 115 is provided inside a rear cover 114 of the image forming apparatus to form a section through which air flows, and radiating fins 112 provided at the end of a heat pipe 111 is disposed within the section. A fan 113 is provided next to the radiating fins 112. A cooling part of the heat pipe 111 is inserted into a sheet conveyance path from an insertion opening formed in the partition wall 115.

In such a configuration, the partition wall 115 must be removed from the rear cover 114 upon detachment of the heat pipe 111, thereby hindering detachment of the heat pipe 111. In addition, because the image forming apparatus is often installed with the rear cover 114 thereof facing a wall of a room, the image forming apparatus must be moved forward to make enough space between the rear cover 114 of the image forming apparatus and the wall of the room to allow removal of the partition wall 115 from the rear cover 114. Further, cool air may leak from a gap between the heat pipe 111 and an insertion opening formed in the rear cover 114.

Figure 6:
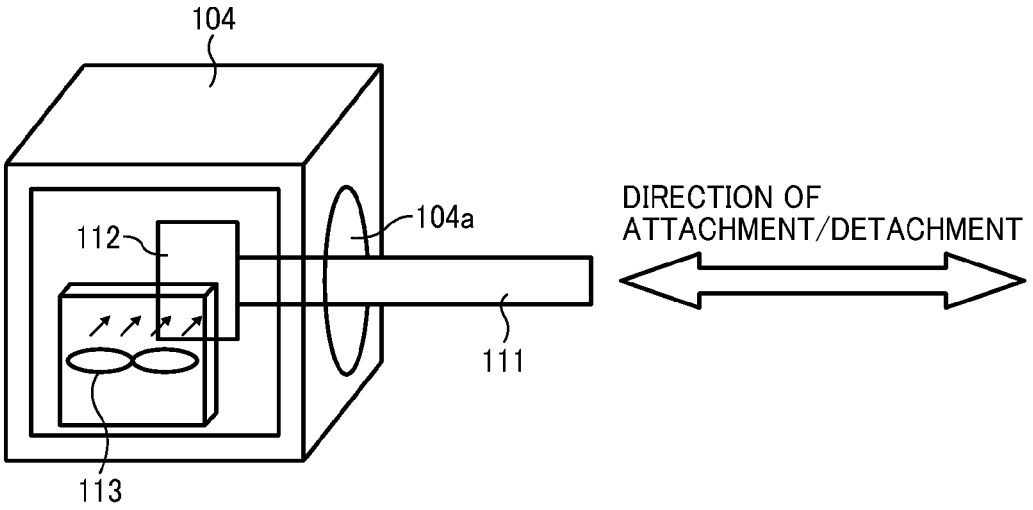
FIG. 6 RELATED ART
FIG. 6 is a schematic view summarizing the configuration and attachment of a related-art cooling device.

FIG. 6 is a schematic view summarizing the configuration and attachment of a related-art cooling device, with the same reference numerals of FIG. 5. According to the related-art cooling device, upon detachment of the heat pipe 111, first a screw, not shown, that fixes a duct 104 to the image forming apparatus is removed, next the duct 104 and the heat pipe 111 are detached from the image forming apparatus, and then the heat pipe 111 is pulled out of the duct 104.

Thus, the duct 104 must be detached from the image forming apparatus upon installation and detachment of the heat pipe 111, thereby hindering installation and detachment of the heat pipe 111. In addition, a gap is generated between the heat pipe 111 and a hole 104*a* formed in the duct 104, into which the heat pipe 111 is inserted, possibly degrading cooling efficiency.

A description is now given of attachment and detachment of the heat pipe 71 to and from the cooling device 70 attached to the fixing device 60 according to the present illustrative embodiment.

Figure 7:
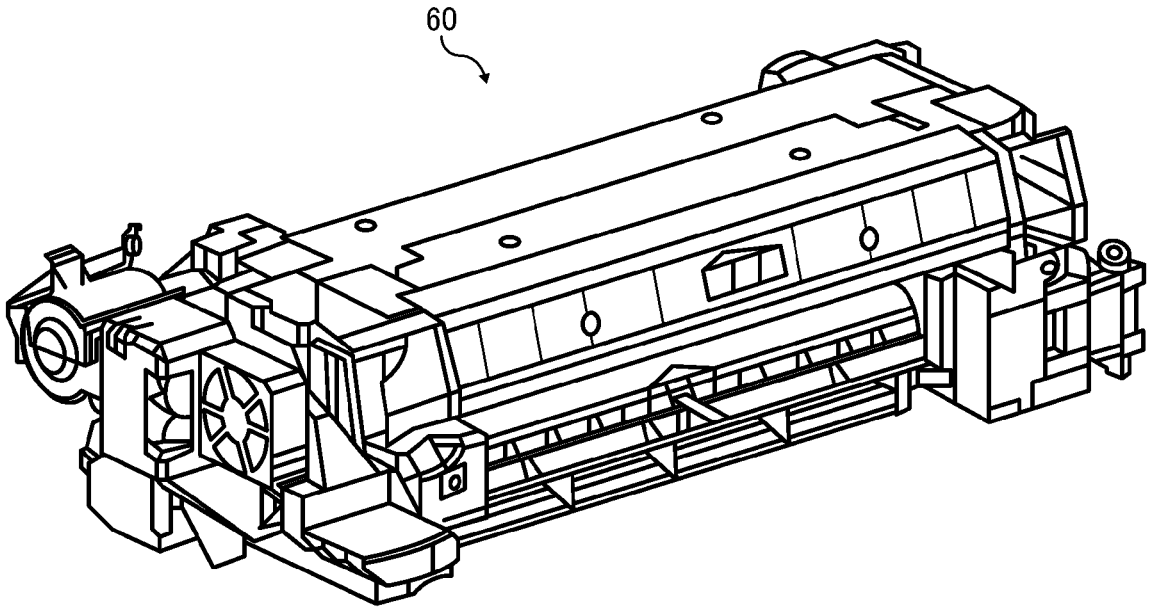
FIG. 7 is a perspective view of the fixing device according to the illustrative embodiment viewed from a different angle from that of FIG. 2.
Figure 8:
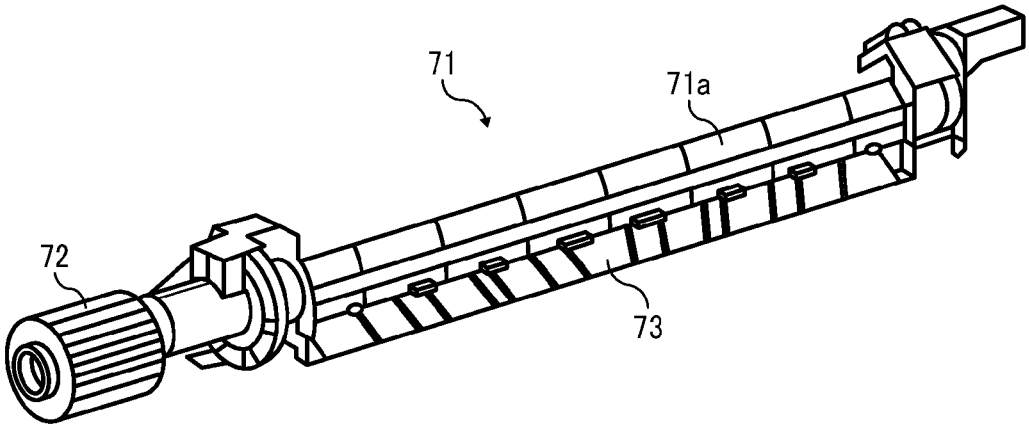
FIG. 8 is a perspective view of a heat pipe included in a cooling device according to the illustrative embodiment.
Figure 9:
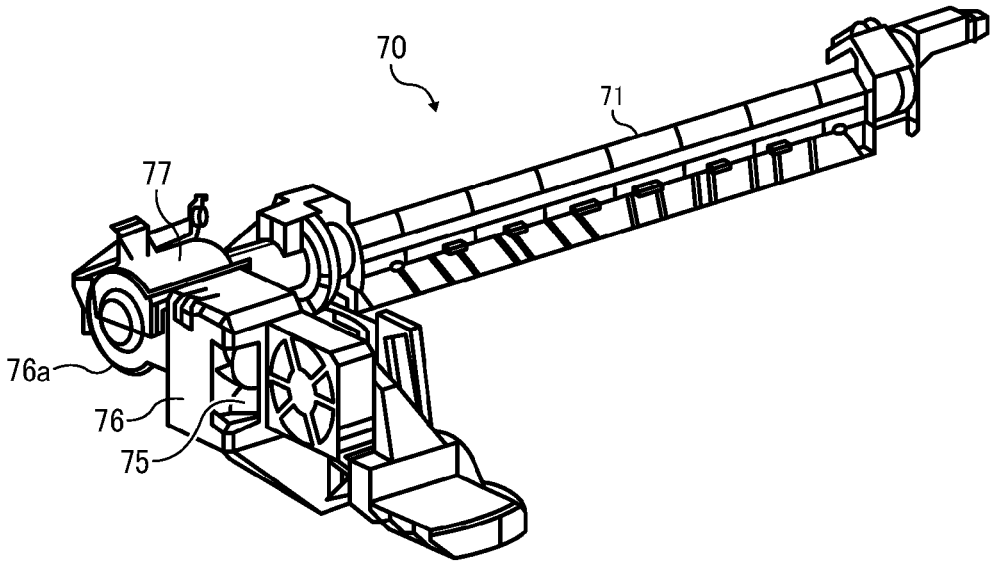
FIG. 9 is a perspective view of the cooling device according to the illustrative embodiment when an upper cover is closed.
Figure 10:
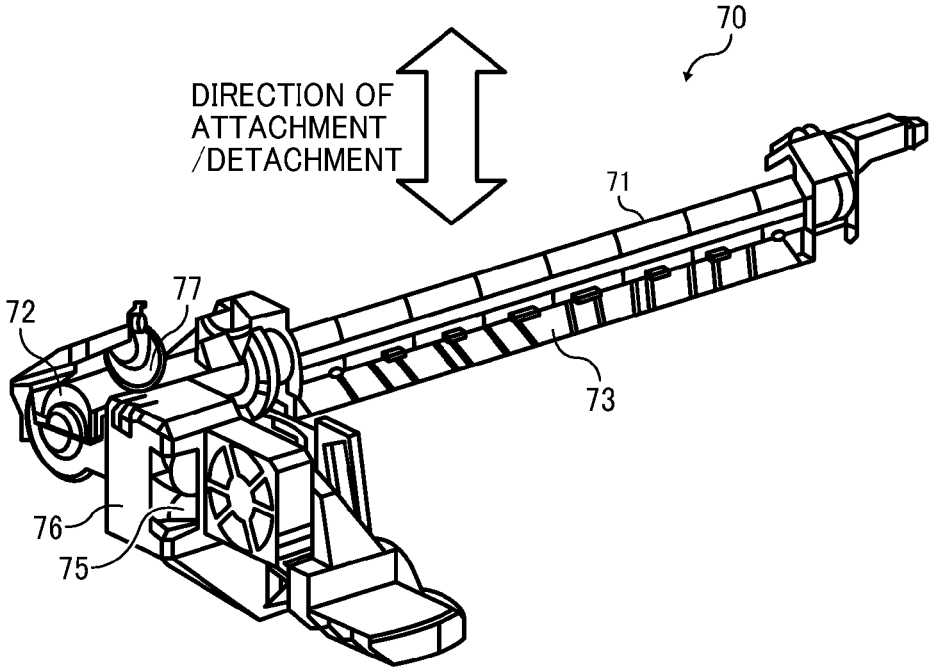
FIG. 10 is a perspective view of the cooling device according to the illustrative embodiment in a state in which the upper cover is opened.

FIG. 7 is a perspective view of the fixing device 60 according to the present illustrative embodiment viewed from a different angle from that of FIG. 2. FIG. 8 is a perspective view of the heat pipe 71 included in the cooling device 70. FIG. 9 is a perspective view of the cooling device 70 when an upper cover 77 is closed. FIG. 10 is a perspective view of the cooling device 70 when the upper cover 77 is opened.

As describe previously, the cooling device 70 formed together with the fixing device 60 is disposed at the discharge part of the fixing device 60. As illustrated in FIG. 8, a radiator, which, in the present illustrative embodiment, is radiating fins 72, is provided to one end of the shaft 71*a* of the heat pipe 71 in a lateral direction. The heat pipe 71 is rotatably supported outside the casing of the fixing device 60 by a support member 73. Returning to FIG. 1, a pair of opposing rollers 74 is disposed opposite the shaft 71*a* of the heat pipe 71 so that the sheet passes between the shaft 71*a* and the pair of opposing rollers 74.

As illustrated in FIGS. 9 and 10, a duct member 76 that accommodates the radiating fins 72 of the heat pipe 71 and an air blower, which, in the present illustrative embodiment, is a cooling fan 75, is disposed on a lateral side of the fixing device 60. The cooling fan 75 is provided near the radiating fins 72 to blow air onto the radiating fins 72. The duct member 76 includes a cover member 76*a* provided with the closably openable upper cover 77. As described above, FIGS. 9 and 10 illustrate the states in which the upper cover 77 is closed and opened, respectively. When the upper cover 77 of the duct member 76 is opened, the radiating fins 72 of the heat pipe 71 are exposed as illustrated in FIG. 10. In such a state, the heat pipe 71 is pulled upward to detach the heat pipe 71 from the support member 73. The heat pipe 71 is detachably attached to the support member 73 in the vertical direction as indicated by the double-headed arrow in FIG. 10. The upper cover 77 provided to the duct member 76 is opened and closed upon attachment and detachment of the heat pipe 71 to and from the support member 73 in the vertical direction (hereinafter also referred to an attachment/detachment direction).

Although being provided at the one end of the shaft 71*a* of the heat pipe 71 in the above-described example, alternatively, a radiating part of the heat pipe 71, which, in the present illustrative embodiment, is the radiating fins 72, may be provided at both ends of the shaft 71*a* of the heat pipe 71. Because the heat pipe 71 is attached to and detached from the support member 73 in the attachment/detachment direction perpendicular to an axial direction of the shaft 71*a* of the heat pipe 71, provision of the radiating fins 72 at both ends of the shaft 71*a* does not hinder attachment and detachment of the heat pipe 71 to and from the support member 73. In addition, provision of the radiating fins 72 at both ends of the shaft 71*a* of the heat pipe 71 increases both radiation effect and cooling efficiency.

In order to detach the heat pipe 71 from the cooling device 70 according to the present illustrative embodiment, first the upper cover 77 is opened, next the heat pipe 71 is pulled upward to detach the heat pipe 71 from the support member 73, and finally the upper cover 77 is closed.

In order to attach the heat pipe 71 to the cooling device 70 according to the present illustrative embodiment, first the upper cover 77 is opened, next the heat pipe 71 is attached to the support member 73, and finally the upper cover 77 is closed.

Figure 11:
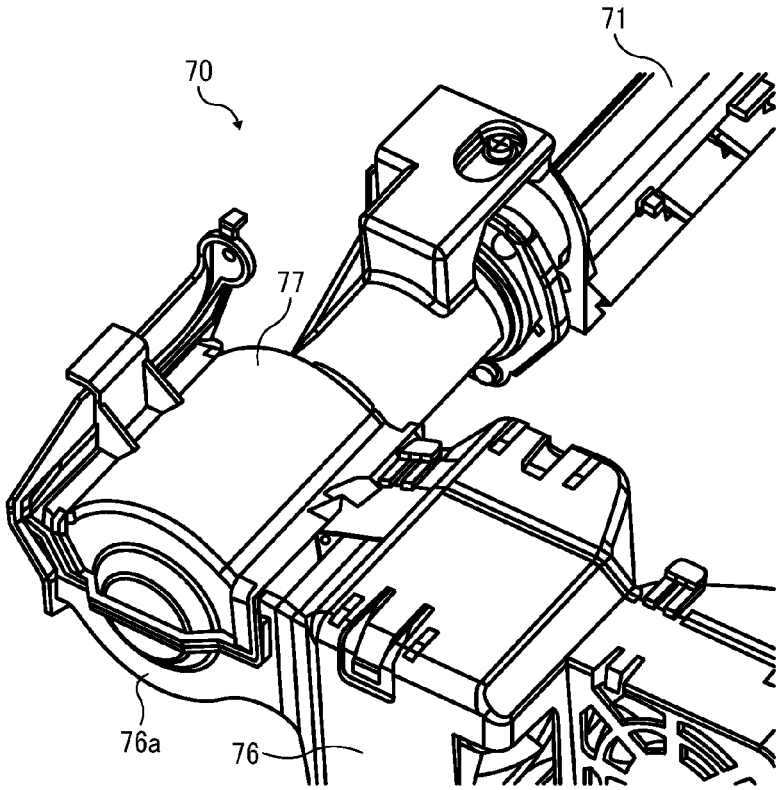
FIG. 11 is a partial perspective view of the cooling device in a state in which the upper cover is closed.
Figure 12:
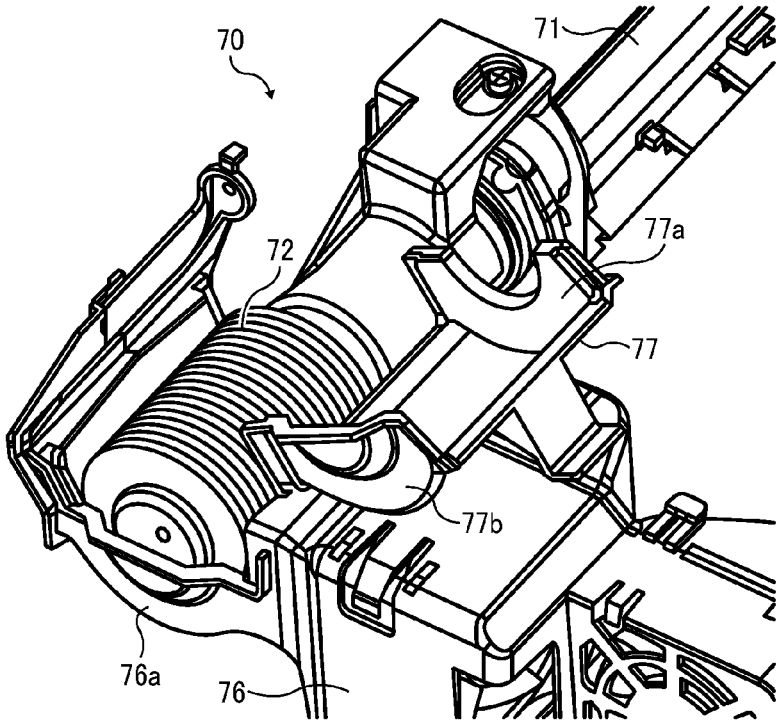
FIG. 12 is a partial perspective view of the cooling device in a state in which the upper cover is opened.

FIGS. 11 and 12 are partial perspective views illustrating the one end of the heat pipe 71 to which the radiating fins 72 are provided in the states in which the upper cover 77 is closed and opened, respectively.

When the upper cover 77 is closed, the radiating fins 72 provided at the end of the heat pipe 71 are covered with the duct member 76 as illustrated in FIG. 11. By contrast, when the upper cover 77 is opened, the radiating fins 72 are exposed as illustrated in FIG. 12 so that the heat pipe 71 can be detached from the cooling device 70.

Thus, according to the present illustrative embodiment, the upper cover 77 is opened upon attachment and detachment of the heat pipe 71 to and from the cooling device 70. At this time, the duct member 76 need not be detached from the cooling device 70, thereby facilitating attachment and detachment of the heat pipe 71 to and from the cooling device 70. In addition, air leakage from the duct member 76 is prevented by closing the upper cover 77.

As illustrated in FIG. 12, a first flange 77*a* having a semicircular cutout formed to conform to the shaft 71*a* of the heat pipe 71 is provided at one end of the upper cover 77, that is, the rear end of the upper cover 77 in the axial direction of the heat pipe 71. In addition, a second flange 77*b* without a cutout is provided at the opposite end of the upper cover 77, that is, the front end of the upper cover 77 in the axial direction of the heat pipe 71. When the upper cover 77 is closed, a front surface of the radiating fins 72 is covered with the second flange 77*b* and the wall of the cover member 76*a* of the duct member 76. At the same time, the first flange 77*a* of the upper cover 77 is closed along the shaft 71*a* of the heat pipe 71 to cover a rear surface of the radiating fins 72. In the cooling device 70 according to the present illustrative embodiment, the upper cover 77 is opened to attach and detach the heat pipe 71 to and from the cooling device 70 without interference of the radiating fins 72 with the duct member 76. Accordingly, the cutout formed to conform to the shaft 71*a* of the heat pipe 71 is provided only to the first flange 77*a*, thereby eliminating provision of holes, into which the radiating fins 72 is inserted, to both the flanges 77*a* and 77*b* respectively provided to both ends of the upper cover 77. As a result, provision of a space for pulling the shaft 71*a* of the heat pipe 71 out from the cooling device 70 is not needed. In addition, a gap generated between the cutout of the first flange 77*a* and the shaft 71*a* of the heat pipe 71 can be reduced. Thus, leakage of the cool air from the cutout can be prevented, thereby achieving higher cooling efficiency.

In the related-art cooling device, the shaft of the heat pipe is loosely inserted into the holes with some play. By contrast, in the present illustrative embodiment, the upper cover 77 is closed after the attachment of the heat pipe 71 to the cooling device 70. As a result, the gap between the cutout formed in the first flange 77*a* of the upper cover 77 and the shaft 71*a* of the heat pipe 71 can be minimized. Alternatively, an elastic member or the like may be attached to the cutout. As a result, the elastic member is compressed upon closing of the upper cover 77 to securely prevent the leakage of the cool air from the gap.

Figure 13:
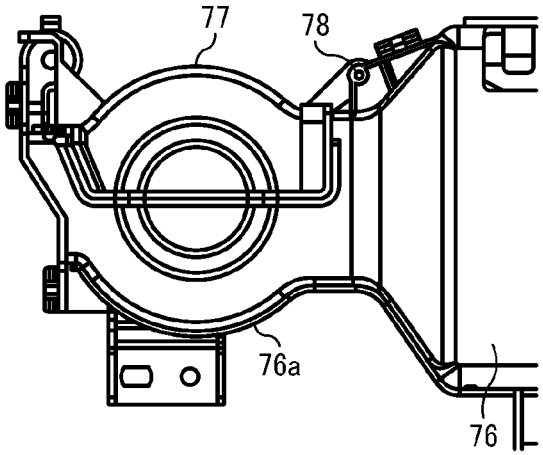
FIG. 13 is a front view of the upper cover in a closed state.
Figure 14:
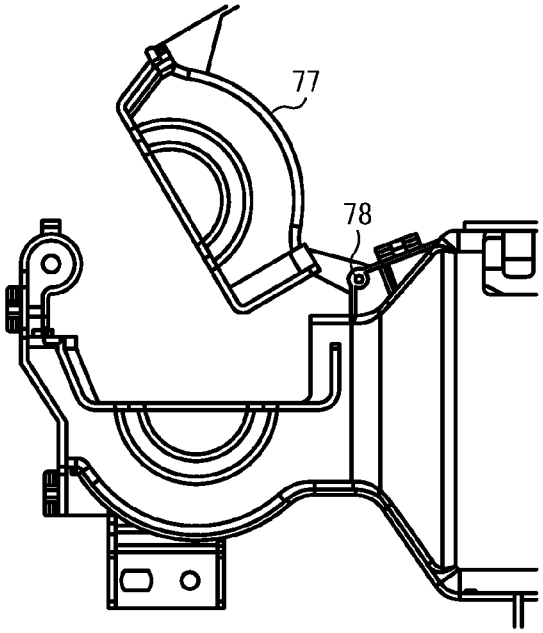
FIG. 14 is a front view of the upper cover in the process of being opened.
Figure 15:
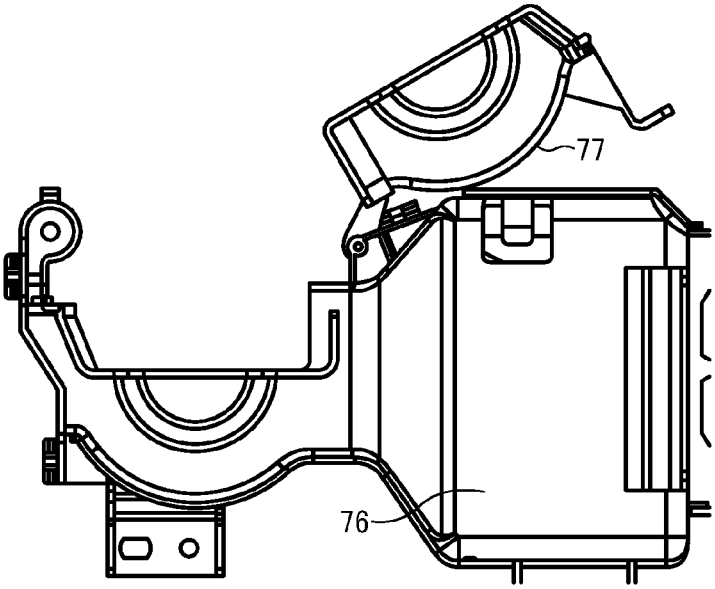
FIG. 15 is a front view of the upper cover in an opened state.

FIG. 13 is a front view of the upper cover 77 in the closed state. The upper cover 77 is rotatable around a shaft 78. When the upper cover 77 is closed, the radiating fins 72 provided at the end of the heat pipe 71 are accommodated within a cylindrical space formed by the upper cover 77 and the cover member 76*a* of the duct member 76 as illustrated in FIG. 13. FIG. 14 is a front view of the upper cover 77 in the process of being opened. When the upper cover 77 is opened as illustrated in FIG. 15, the heat pipe 71 can be detached upward from the cooling device 70 without the radiating fins 72 being contacted by the duct member 76 and the upper cover 77.

In the present illustrative embodiment, the upper cover 77 is provided to an upper surface of the duct member 76 so as to attach and detach the heat pipe 71 to and from the cooling device 70 from above. Alternatively, a cover may be provided to a front surface of the duct member 76 in a case in which the heat pipe 71 is attached to and detached from the cooling device 70 from the front.

Figure 16:
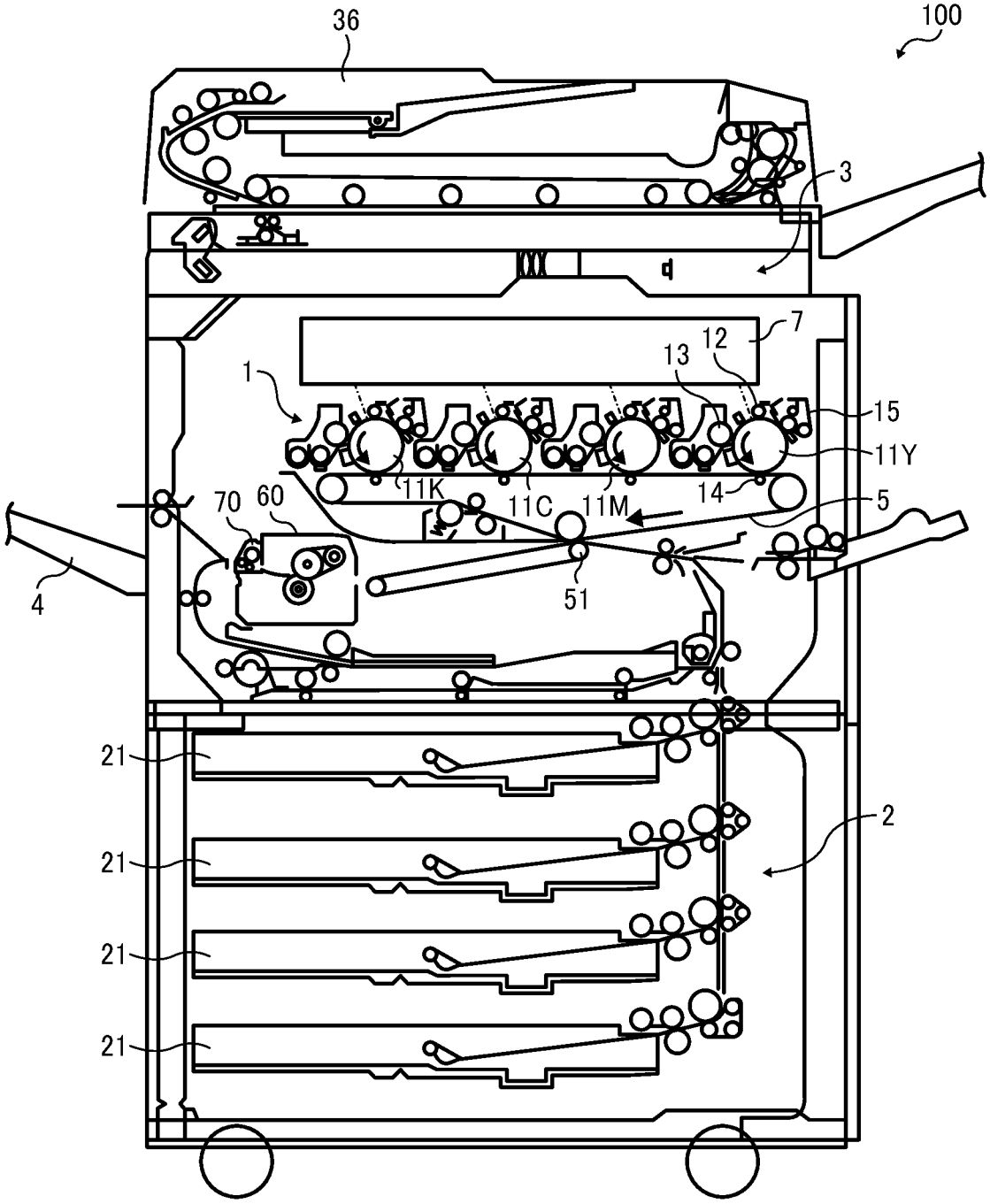
FIG. 16 is a vertical cross-sectional view illustrating an example of a configuration of an image forming apparatus including the fixing device according to the illustrative embodiment.

A description is now given of an image forming apparatus 100 including the fixing device 60 according to the present illustrative embodiment with reference to FIG. 16. FIG. 16 is a vertical cross-sectional view illustrating an example of a configuration of the image forming apparatus 100.

The image forming apparatus 100 is a full-color copier and includes an image forming part 1, a sheet feeder 2 disposed below the image forming part 1, and an image reader 3 disposed above the image forming part 1. An automatic document feeder (ADF) 36 is provided above the image reader 3. The image forming part 1 includes the fixing device 60, and the cooling device 70 is attached to the fixing device 60.

The image forming part 1 further includes an intermediate transfer belt 5 having a horizontally extended transfer surface, and components that form images of colors complementary to separated color components are provided above the intermediate transfer belt 5. Specifically, image carriers, which, in the present illustrative embodiment, are photoconductors 11Y, 11M, 11C, and 11K (hereinafter collectively referred to as photoconductors 11), each carrying a toner image of a specific color, that is, yellow (Y), magenta (M), cyan (C), or black (K), are arranged side by side along the transfer surface of the intermediate transfer belt 5. An optical writing device 7 is disposed above the photoconductors 11.

Each photoconductor 11 is constructed of a drum rotatable in a counterclockwise direction in FIG. 16. A charger 12, a developing device 13, a primary transfer device 14, and a cleaning device 15 are provided around each photoconductor 11. It is to be noted that, for ease of illustration, the reference numerals for the components provided around each photoconductor 11 are shown only for the photoconductor 11Y in FIG. 16. Each developing device 13 stores toner of the specified color, that is, yellow (Y), magenta (M), cyan (C), or black (K).

The intermediate transfer belt 5 is wound around a drive roller and driven rollers and is rotated in a clockwise direction in FIG. 16. A secondary transfer roller 51 is disposed opposite one of the driven rollers. A sheet on which a toner image is formed is conveyed from the secondary transfer roller 51 to the fixing device 60 by a conveyance belt.

The sheet feeder 2 includes multiple sheet trays 21 disposed one above the other to accommodate the sheets, respectively, and a sheet feed member provided for each sheet tray 21 that separates a top sheet from the rest of the sheets accommodated within the sheet tray 21 to feed the top sheet to the image forming part 1.

During formation of, for example, a yellow toner image, the optical writing device 7 directs laser light onto a surface the photoconductor 11Y, which is evenly charged by the charger 12, based on image data of a document read by the image reader 3, so that an electrostatic latent image of yellow is formed on the surface of the photoconductor 11Y. The electrostatic latent image is then developed with yellow toner supplied from the developing device 13 to form a yellow toner image on the photoconductor 11Y. The yellow toner image thus formed on the photoconductor 11Y is primarily transferred onto the intermediate transfer belt 5 by the primary transfer device 14, to which a predetermined bias is applied. The above-described image forming processes are also performed on the rest of the photoconductors 11M, 11C, and 11K, differing only in the color of toner used, so that toner images of the specified colors are sequentially transferred onto the intermediate transfer belt 5 one atop the other to form a single full-color toner image on the intermediate transfer belt 5.

The full-color toner image thus formed on the intermediate transfer belt 5 is then secondarily transferred onto the sheet conveyed between the secondary transfer roller 51 and the opposing roller provided opposite the secondary transfer roller 51 with the intermediate transfer belt 5 interposed therebetween. The sheet having the full-color toner image thereon is conveyed to the fixing device 60. As described previously, the fixing device 60 includes the fixing belt 61 wound around the fixing roller 62 and the pressing roller 65 provided opposite the fixing roller 62 with the fixing belt 61 interposed therebetween. The full-color toner image is fixed onto the sheet at the nip between the fixing belt 61 and the pressing roller 65. The cooling device 70 is disposed at the discharge part of the fixing device 60 so that the sheet having the fixed image thereon is cooled by the heat pipe 71 included in the cooling device 70 while being conveyed. Thereafter, the sheet is discharged from the image forming apparatus 100 and is stacked on a discharge tray 4.

The fixing device 60 is detachably installed in the image forming apparatus 100. Upon attachment and detachment of the heat pipe 71 to and from the cooling device 70, the fixing device 60 may be either detached from the image forming apparatus 100 or remain installed in the image forming apparatus 100.

In the image forming apparatus 100 illustrated in FIG. 16, the fixing device 60 can be easily accessed by simply opening a front cover of the image forming apparatus 100. Thus, the heat pipe 71 is attached to and detached from the cooling device 70 from the front side of the image forming apparatus 100, thereby facilitating attachment and detachment of the heat pipe 71 to and from the cooling device 70.

The foregoing illustrative embodiment is not limited to the above-described example. Although being attached to the fixing device 60 in the above-described example, alternatively, the cooling device 70 may be disposed separately from the fixing device 60. The foregoing illustrative embodiment is also applicable to a cooling device that cools a sheet heated by a heat source other than the fixing device.

The heat pipe 71 may be attached to and detached from the cooling device 70 not only in the vertical direction but also in a direction corresponding to the position of the cooling device 70. For example, the heat pipe 71 may be pulled out of the cooling device 70 to the front or the horizontal direction.

In addition, although being rotated upon opening, the upper cover 77 may slide open or be detachably snapped onto the duct member 76.

In place of the belt fixing system, the fixing device 60 may employ a heat roll system using a fixing roller and a pressing roller. Although the fixing heater 64 is provided within the heat roller 63, alternatively, the heat roller 63 may be heated from outside. Further alternatively, the fixing device 60 may employ an induction heating system.

Similarly, in place of the tandem-type configuration, other image forming configurations may be employed in the image forming apparatus 100. Although the intermediate transfer system is employed, alternatively, the direct transfer system may be employed in the image forming apparatus 100. The foregoing illustrative embodiment is also applicable to full-color image forming apparatuses using toner of three colors, multi-color image forming apparatuses using toner of two colors, or monochrome image forming apparatuses. In addition, the foregoing illustrative embodiment is applicable not only to copiers but also to printers, facsimile machines, and multifunction devices having two or more of copying, printing, and facsimile capabilities.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A cooling device, comprising:

a heat pipe configured to cool a sheet, the heat pipe being configured to be attachable to and detachable from the cooling device;

a radiator at one end of the heat pipe; and a duct configured to accommodate the radiator and including a cover member configured to be opened and closed, wherein when the cover member is opened, the cover member is configured to enable at least one of attachment and detachment of the heat pipe to and from the cooling device in a direction.

2. The cooling device according to claim 1, wherein the cover member is configured to be rotatably hinged around a rotary shaft.

3. The cooling device according to claim 1, wherein the direction of attachment and detachment of the heat pipe to and from the cooling device is perpendicular to an axial direction of the heat pipe.

4. The cooling device according to claim 1, wherein the radiator is at the one end of the heat pipe in the axial direction.

5. The cooling device according to claim 1, wherein the radiator comprises:

radiating fins protruding from the end of the heat pipe in a direction perpendicular to an axial direction of the heat pipe.

6. The cooling device according to claim 1, further comprising:

an air blower within the duct, the air blower being configured to blow air onto the radiator.

7. An image forming apparatus comprising:

a fixing device configured to fix a toner image onto a sheet with heat; and a cooling device provided downstream from the fixing device in a direction of conveyance of the sheet to cool the sheet after fixing of the toner image onto the sheet, the cooling device including, a heat pipe configured to cool a sheet, the heat pipe being configured to be attachable to and detachable from the image forming apparatus;

a radiator at one end of the heat pipe; and a duct configured to accommodate the radiator and including a cover member configured to be opened and closed, wherein when the cover member is opened, the cover member is configured to enable at least one of attachment and detachment of the heat pipe to and from the image forming apparatus in a direction.

8. The image forming apparatus according to claim 7, wherein, the cooling device is attached to the fixing device; and the heat pipe is supported outside a casing of the fixing device.

9. The image forming apparatus according to claim 7, further comprising:

a cover provided to a side of the image forming apparatus, wherein the cover is configured to be opened to allow access to the cooling device.

* * * * *